US005806742A

United States Patent [19]

Mott et al.

[11] Patent Number: 5,806,742

[45] Date of Patent: Sep. 15, 1998

[54] RIFLE PACK WITH SHOULDER STRAPS

[76] Inventors: Dennis L. Mott, P.O. Box 73; William J. Goebel, P.O. Box 132, both of Eagle, Ak. 99738

[21] Appl. No.: 804,833

[22] Filed: Feb. 24, 1997

[51] Int. Cl.[6] ..... F41C 33/02

[52] U.S. Cl. ..... 224/645; 224/150; 224/627; 224/652; 224/913; 224/628

[58] Field of Search ..... 224/913, 150, 224/627, 645, 916, 911, 915, 628; 206/317

[56] References Cited

U.S. PATENT DOCUMENTS

| | | | |
|---|---|---|---|
| 995,458 | 6/1911 | Harriman | 224/913 |
| 2,456,247 | 12/1948 | Bernau | 224/655 |
| 2,524,931 | 10/1950 | Schoellkope, Jr. et al. | 206/317 |
| 2,781,808 | 2/1957 | Barnard | 224/626 |
| 4,024,997 | 5/1977 | Kolpin | 224/913 |
| 5,016,793 | 5/1991 | Derkatz | 224/150 |
| 5,619,819 | 4/1997 | Hanschild | 224/913 |
| 5,664,721 | 9/1997 | Homeyer | 224/913 |

*Primary Examiner*—Linda J. Sholl

[57] ABSTRACT

A rifle pack with shoulder straps including an elongated housing having a front face and a rear face integrally coupled to define an interior space with a top opening. The front face and rear face both taper inwardly from a top extent to a bottom extent thereof. A closure flap is included for selectively covering the top opening of the housing. Further provided are two thin rectangular shoulder straps coupled to the rear face of the housing. Finally, a utility pouch is included with a plurality of bellows coupled between side edges of a front face and rear face thereof. A flap is coupled to a top edge of the pouch for allowing selective access within the pouch.

1 Claim, 2 Drawing Sheets

RIFLE PACK WITH SHOULDER STRAPS

BACKGROUND OF THE INVENTION

1. Field of the Invention

The present invention relates to a rifle pack with shoulder straps and more particularly pertains to carrying a rifle in an inverted orientation about the shoulders of a user with a rifle pack which has a utility pouch.

2. Description of the Prior Art

The use of gun cases is known in the prior art. More specifically, gun cases heretofore devised and utilized for the purpose of carrying guns are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,756,456 to Schauer; U.S. Pat. No. 4,249,687 to Warnier; U.S. Pat. No. Des. 358,255 to Sharp et al.; U.S. Pat. No. Des. 347,322 to Fiore; U.S. Pat. No. Des. 336,984 to VanSkiver; and U.S. Pat. No. Des. 320,113 to VanSkiver.

In this respect, the rifle pack with shoulder straps according to the present invention substantially departs from the conventional concepts and designs of the prior art, and in so doing provides an apparatus primarily developed for the purpose of carrying a gun in an inverted orientation about a shoulder of a user with a rifle pack which has a utility pouch.

Therefore, it can be appreciated that there exists a continuing need for a new and improved rifle pack with shoulder straps which can be used for carrying a gun in an inverted orientation about a shoulder of a user with a rifle pack which has a utility pouch. In this regard, the present invention substantially fulfills this need.

SUMMARY OF THE INVENTION

In view of the foregoing disadvantages inherent in the known types of gun cases now present in the prior art, the present invention provides an improved rifle pack with shoulder straps. As such, the general purpose of the present invention, which will be described subsequently in greater detail, is to provide a new and improved rifle pack with shoulder straps which has all the advantages of the prior art and none of the disadvantages.

To attain this, the present invention essentially comprises an elongated housing constructed from a flexible weather resistant material in the group of materials in which canvas is included. As shown in the Figures, the housing has a front face and a rear face integrally coupled along bottom and side peripheries thereof to the same of the front face. As such, the housing has an interior space with a top opening. It is imperative that the front face and rear face both taper inwardly from a top extent to a bottom extent thereof. As best shown in FIG. 4, a gun barrel stop is included. Ideally, the barrel stop is constructed from a rigid material in the group of materials including plastic. The gun barrel stop has a bottom face and a periphery integrally coupled thereto and extending upwardly therefrom to form an open top. The gun barrel stop is situated within the housing. Further provided is a closure flap constructed from a material similar to that of the housing. The closure flap has a rectangular configuration with a first side edge thereof integrally coupled to the rear face of the housing adjacent the top opening thereof. A first pile fastener is situated adjacent a second side edge of the flap opposite the first side edge thereof. Associated therewith is a second pile fastener situated on the front face of the housing adjacent the top opening thereof. By this structure, the closure flap has a first orientation with the closure flap covering the top opening of the housing and the first pile fastener engaged with the second pile fastener for precluding access within the housing. For allowing a rifle to be selectively stored within the housing, the closure flap further has a second orientation with the first pile fastener disengaged with the second pile fastener. It should be noted that the specific structure of the present invention is specifically tailored to allow the rifle to be stored in an inverted orientation. For storing ammunition and the like, a utility pouch is included having a rear face coupled to the front face of the housing adjacent the top opening thereof. The utility pouch further has a front face with a pile fastener coupled thereto. A bottom face of the pouch is coupled between bottom edges of the front face and the rear face thereof. A plurality of bellows are coupled between side edges of the front face and the rear face of the pouch defining an open top. Finally, a flap has a first end integrally coupled to a top edge of the rear face. A pile fastener is coupled to the flap for allowing selective access within the pouch. As best shown in FIG. 3, a pair of thin rectangular shoulder straps are provided. The shoulder straps each have a top extent stitchedly coupled at a first end thereof to the rear face of the housing adjacent the top opening thereof. Fixedly coupled at a second end of the top extent of each of the straps is a coupling means. The straps further each include a bottom extent stitchedly coupled at a first end thereof to the rear face of the housing adjacent a bottom thereof. As such, a second end of the bottom extent of the straps may be releasably coupled to the coupling means such that the length of the rectangular straps is adjustable for fitting about a shoulder of user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rifle pack with shoulder straps which has all the advantages of the prior art gun cases and none of the disadvantages.

It is another object of the present invention to provide a new and improved rifle pack with shoulder straps which may be easily and efficiently manufactured and marketed.

It is a further object of the present invention to provide a new and improved rifle pack with shoulder straps which is of a durable and reliable construction.

An even further object of the present invention is to provide a new and improved rifle pack with shoulder straps which is susceptible of a low cost of manufacture with regard to both materials and labor, and which accordingly is then susceptible of low prices of sale to the consuming public, thereby making such rifle pack with shoulder straps economically available to the buying public.

Still yet another object of the present invention is to provide a new and improved rifle pack with shoulder straps which provides in the apparatuses and methods of the prior art some of the advantages thereof, while simultaneously overcoming some of the disadvantages normally associated therewith.

Still another object of the present invention is to carry a gun in an inverted orientation about a shoulder of a user with a rifle pack which has a utility pouch.

Lastly, it is an object of the present invention to provide a rifle pack with shoulder straps including an elongated housing having a front face and a rear face integrally coupled to define an interior space with a top opening. The front face and rear face both taper inwardly from a top extent to a bottom extent thereof. A closure flap is included for selectively covering the top opening of the housing. Further provided are two thin rectangular shoulder straps coupled to the rear face of the housing. Finally, a utility pouch is included with a plurality of bellows coupled between side edges of a front face and rear face thereof. A flap is coupled to a top edge of the pouch for allowing selective access within the pouch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
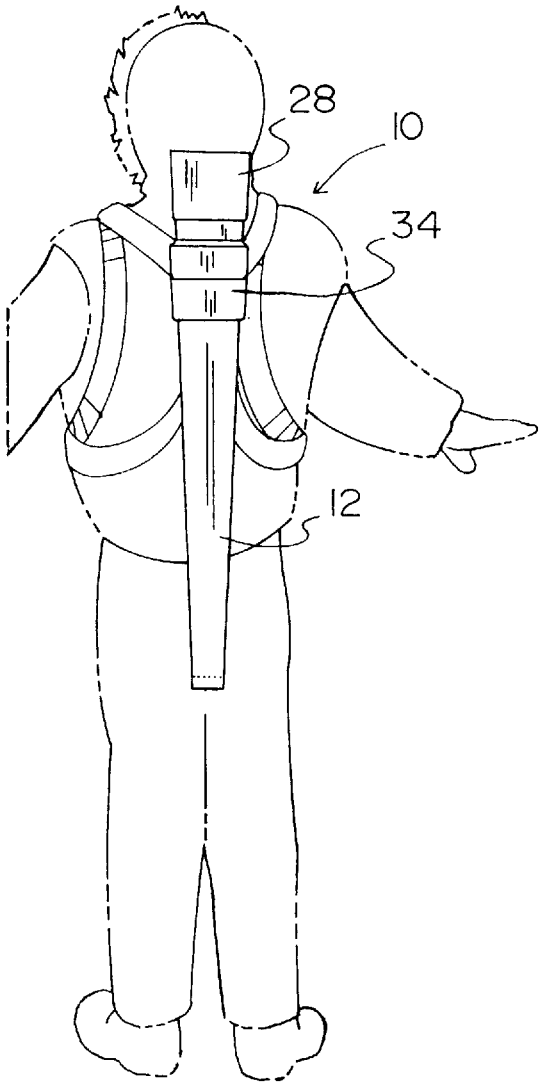
FIG. 1 is a perspective illustration of the preferred embodiment of the rifle pack with shoulder straps constructed in accordance with the principles of the present invention.
Figure 2:
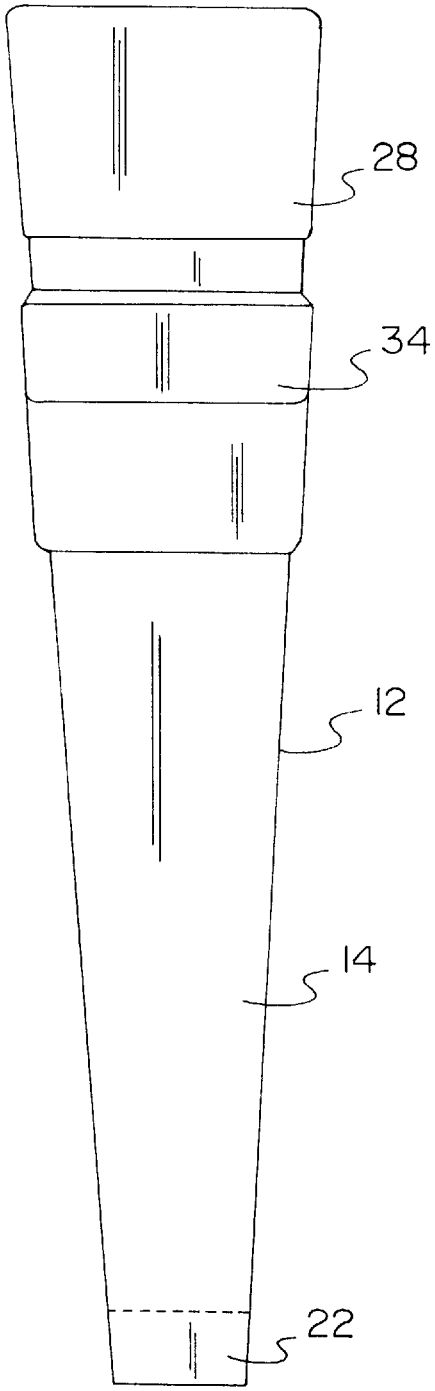
FIG. 2 is a front elevational view of the present invention.

With reference now to the drawings, and in particular to FIG. 1 thereof, a new and improved rifle pack with shoulder straps embodying the principles and concepts of the present invention and generally designated by the reference numeral 10 will be described.

The present invention, the new and improved rifle pack with shoulder straps, is comprised of a plurality of components. Such components in their broadest context include an elongated housing, a barrel stop, a closure flap, a utility pouch, and a shoulder strap. Such components are individually configured and correlated with respect to each other so as to attain the desired objective.

Figure 3:
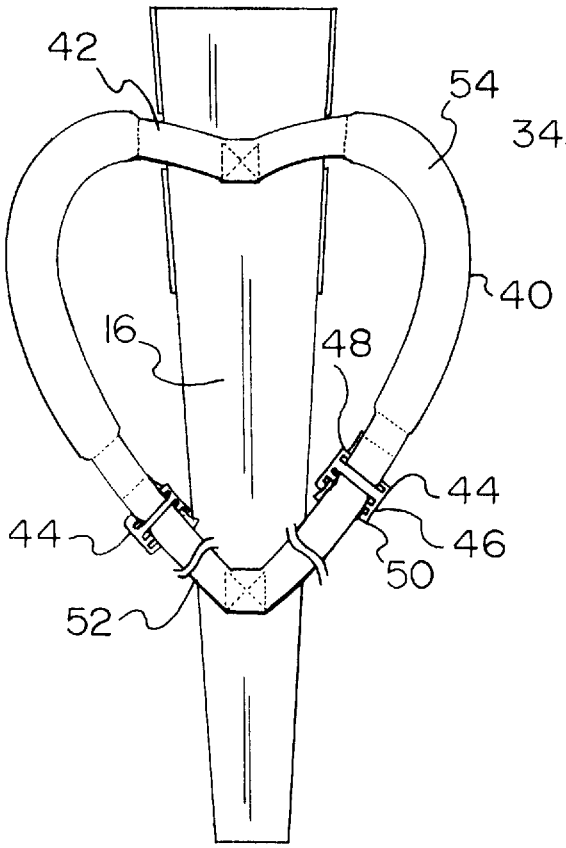
FIG. 3 is a rear elevational view of the present invention.

More specifically, it will be noted that the system 10 of the present invention includes an elongated housing 12 constructed from a flexible weather resistant material in the group of materials in which canvas is included. Optionally, materials such as leather and various durable flexible cloths may be utilized in lieu of canvas. By this unique choice of material, the housing may be rolled up and stored. As shown in the Figures, the housing has a front face 14 and a rear face 16 integrally coupled along bottom and side peripheries thereof to the same of the front face. As such, the housing has an interior space 18 with a top opening 20. It is imperative that the front face and rear face both taper inwardly from a top extent to a bottom extent thereof. As shown in FIG. 3, the top extent has a width about three times that of the bottom extent. Ideally, the housing has a length of approximately 45 inches and a width of about 6–8 inches.

Figure 4:
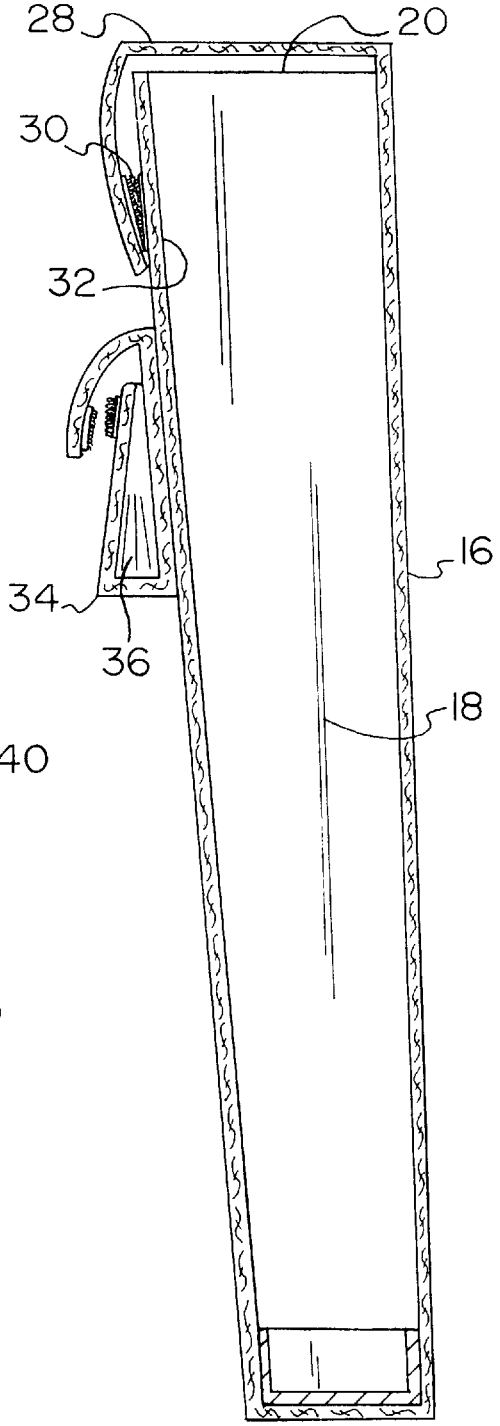
FIG. 4 is a cross-sectional view of the present invention taken along the length thereof.

As best shown in FIG. 4, a gun barrel stop 22 is included. Ideally, the barrel stop is constructed from a rigid material in the group of materials including plastic. The gun barrel stop has a bottom face 24 and a periphery 26 integrally coupled thereto and extending upwardly therefrom to form an open top. The gun barrel stop is situated within the housing adjacent a bottom thereof.

Further provided is a closure flap 28 constructed from a material similar to that of the housing. The closure flap has a rectangular configuration with a first side edge thereof integrally coupled to the rear face of the housing adjacent the top opening thereof. A first pile fastener 30 is situated adjacent a second side edge of the flap opposite the first side edge thereof. Associated therewith is a second pile fastener 32 situated on the front face of the housing adjacent the top opening thereof. By this structure, the closure flap has a first orientation with the closure flap covering the top opening of the housing and the first pile fastener engaged with the second pile fastener for precluding access within the housing. For allowing a rifle to be selectively stored within the housing, the closure flap further has a second orientation with the first pile fastener disengaged with the second pile fastener. It should be noted that the specific structure of the present invention is specifically tailored to allow the rifle to be stored in an inverted orientation.

For storing ammunition and the like, a utility pouch 34 is included having a rear face coupled to the front face of the housing adjacent the top opening thereof. The utility pouch further has a front face with a pile fastener coupled thereto. A bottom face of the pouch is coupled between bottom edges of the front face and the rear face thereof. A plurality of bellows 36 are coupled between side edges of the front face and the rear face of the pouch defining an open top. Finally, a flap 38 has a first end integrally coupled to a top edge of the rear face. A pile fastener is coupled to the flap for allowing selective access within the pouch.

As best shown in FIG. 3, a pair of shoulder straps 40 are included for allowing the case to be worn on a back of a user. The shoulder straps each include a top extent 42 stitchedly coupled at a first end thereof to the rear face of the housing adjacent the top opening thereof. Fixedly coupled at a second end of the top extent of the strap is a coupling means 44. Preferably, the coupling means comprises a rectangular plate 46 with a first pair of slits 48 formed therein. The first pair of slits are for allowing the top extent of the strap to be coupled thereto in a closed loop configuration. A second pair of slits 50 are formed in an opposite end of the plate for purposes that will become apparent hereinafter. The straps each further include a bottom extent 52 stitchedly coupled at a first end thereof to the rear face of the housing adjacent a bottom thereof. As such, a second end of the bottom extent of each of the straps may be interweaved within the second pair of slits of the coupling plate such that the length of the rectangular straps is adjustable for fitting about the shoulders of user thereby allowing the case to be worn in a manner similar to a back pack.

Finally, a shoulder pad 54 with a rectangular configuration is coupled to the top extent of each of the shoulder straps for providing comfort to the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rifle pack with shoulder straps comprising, in combination:

an elongated housing constructed from a flexible weather resistant canvas material, the housing having a front face and a rear face integrally coupled along bottom and side peripheries thereof to the same of the front face thereby defining an interior space with a top opening, wherein the front face and rear face both taper inwardly from a top extent to a bottom extent thereof, wherein the top extent has a width equal to about three times that of the bottom extent;

a gun barrel stop constructed from a plastic rigid material, the gun barrel stop having a bottom face and a periphery integrally coupled thereto and extending upwardly therefrom to form an open top, wherein the gun barrel stop is situated within the interior space of the housing at a bottom thereof;

a closure flap constructed from a material similar to that of the housing, the closure flap having a rectangular configuration with a first side edge thereof integrally coupled to the rear face of the housing adjacent the top opening thereof, a first pile fastener situated adjacent a second side edge opposite the first side edge thereof, and a second pile fastener situated on the front face of the housing adjacent the top opening thereof, whereby the closure flap has a first orientation with the closure flap covering the top opening of the housing and the first pile fastener engaged with the second pile fastener for precluding access within the housing and a second orientation with the first pile fastener disengaged with the second pile fastener for allowing a rifle to be selectively stored within the housing;

a utility pouch having a rear face coupled to the front face of the housing adjacent the top opening thereof, a front face with a pile fastener coupled thereto, a bottom face coupled between bottom edges of the front face and the rear face of the pouch, a plurality of bellows coupled between side edges of the front face and the rear face of the pouch, an open top, and a flap with a first end integrally coupled to a top edge of the rear face with a pile fastener coupled thereto for allowing selective access within the pouch; and a pair of shoulder straps for allowing the case to be worn on a back of a user, the shoulder straps each including:

a thin rectangular shoulder strap including a top extent stitchedly coupled at a first end thereof to the rear face of the housing adjacent the top opening thereof and fixedly coupled at a second end thereof to a coupling means with the coupling means including a rectangular plate with at least one first slit for allowing the top extent of the strap to be coupled thereto in a closed configuration and a second pair of slits formed in an opposite end of the plate, the strap further including a bottom extent stitchedly coupled at a first end thereof to the rear face of the housing adjacent a bottom thereof, wherein a second end of the bottom extent of the strap is releasably coupled to the coupling means such that the length of the rectangular strap is adjustable for fitting about a shoulder of user and a shoulder pad with a rectangular configuration coupled to the top extent of the shoulder strap.

* * * * *